US011649671B2

(12) United States Patent
Geiger

(10) Patent No.: US 11,649,671 B2
(45) Date of Patent: May 16, 2023

(54) WINDOW SHADE MOUNTING SYSTEM FOR CURTAIN WALLS

(71) Applicant: Geigtech East Bay, LLC, Charleston, SC (US)

(72) Inventor: James Geiger, Charleston, SC (US)

(73) Assignee: Geigtech East Bay, LLC, Charleston, SC (US)

( * ) Notice: Subject to any disclaimer, the term of this patent is extended or adjusted under 35 U.S.C. 154(b) by 369 days.

(21) Appl. No.: 16/989,669

(22) Filed: Aug. 10, 2020

(65) Prior Publication Data

US 2020/0399958 A1 Dec. 24, 2020

Related U.S. Application Data

(63) Continuation-in-part of application No. 16/543,537, which is a continuation-in-part of application No. 16/376,814, filed on Apr. 5, 2019, now Pat. No. 10,822,872, which is a continuation of application No. 16/035,079, filed on Jul. 13, 2018, now Pat. No. 10,415,307, which is a continuation of application No. 15/994,687, filed on May 31, 2018, now Pat. No. 10,294,717, which is a continuation of application No. 14/997,211, filed on Jan. 15, 2016, now Pat. No. 9,988,839, which is a continuation-in-part of application No. 14/401,453, filed as application No. PCT/US2013/041175 on May 15, 2013, now Pat. No. 9,237,821.

(60) Provisional application No. 62/885,032, filed on Aug. 9, 2019, provisional application No. 61/647,445, filed on May 15, 2012.

(51) Int. Cl.
*E06B 9/50* (2006.01)
*A47H 1/13* (2006.01)

(52) U.S. Cl.
CPC ..... *E06B 9/50* (2013.01); *A47H 1/13* (2013.01)

(58) Field of Classification Search
CPC ..... E06B 9/50; A47H 1/13
See application file for complete search history.

(56) References Cited

U.S. PATENT DOCUMENTS 5,253,459 A * 10/1993 Parinas ..... E04B 2/96 52/235
6,196,508 B1 * 3/2001 Nijs ..... A47H 1/13 248/267

(Continued)

*Primary Examiner* — Anita M King
(74) *Attorney, Agent, or Firm* — Kim and Lahey Law Firm, LLC; Douglas William Kim

(57) ABSTRACT

A window shade mounting system for use with a curtain wall structure comprising: a mounting plate secured to a building material and the mounting plate is disposed in a cavity defined by a curtain wall assembly, the building material, a fire block; a support plate removable carried by the mounting plate; a bracket attached to the mounting plate having a first end configured to bear against the mounting plate; a member included in the bracket wherein the member is configured to engage a roller window shade assembly and the member configured to limit rotation of at least a portion of the roller window shade assembly; a passage defined in the bracket for receiving a wire that travels from the cavity, through the passage and connects to a roller shade assembly motor included in the roller window shade assembly; and, a decorative plate attached to the support plate.

20 Claims, 7 Drawing Sheets

(56) References Cited

U.S. PATENT DOCUMENTS

| | | | | |
|---|---|---|---|---|
| 7,677,294 | B2 * | 3/2010 | Bohlen | E06B 9/50 160/323.1 |
| 8,151,859 | B2 * | 4/2012 | Koop | E06B 9/50 160/321 |
| 8,967,568 | B2 * | 3/2015 | Wills | E06B 9/50 248/269 |
| 10,294,717 | B2 * | 5/2019 | Geiger | A47H 1/13 |
| 10,704,324 | B2 * | 7/2020 | Goldberg | E06B 9/50 |
| 10,745,966 | B2 * | 8/2020 | Chen | E06B 9/42 |
| 2012/0126077 | A1 * | 5/2012 | Reo | F16M 13/02 248/224.8 |

* cited by examiner

WINDOW SHADE MOUNTING SYSTEM FOR CURTAIN WALLS

RELATED APPLICATIONS

This application is a continuation in part of U.S. patent application Ser. No. 16/376,814 filed Apr. 5, 2019 and U.S. patent application Ser. No. 16/543,534 filed Aug. 17, 2019 which are continuations of U.S. patent application Ser. No. 16/035,079 filed Jul. 13, 2018 (now U.S. Pat. No. 10,415,307), continuations of U.S. patent application Ser. No. 15/994,687 filed May 31, 2018 (now U.S. Pat. No. 10,294,717), continuations of U.S. patent application Ser. No. 14/997,211 filed Jan. 15 2016 (now U.S. Pat. No. 9,988,839), continuations-in-part of U.S. patent application Ser. No. 14/401,453 filed Nov. 14, 2014 (now U.S. Pat. No. 9,237,821), a National Stage Entry of PCT application PCT/US2013/041175 and claim priority from U.S. Provisional Application 61/647,445 filed May 15, 2012, all of which are incorporated by reference.

BACKGROUND OF THE INVENTION

1) Field of the Invention

This system is directed to an aesthetically pleasing window shade mounting system for roller shades for use with a curtain wall structure.

2) Description of the Related Art

In buildings that have mounted exterior surfaces, such as glass, a curtain wall structure is used as shown in FIG. 1 and in U.S. Pat. No. 5,253,459. The building support structure 10 can be a concrete slab or other material. Vertical curtain wall mullion 14 and horizontal curtain wall mullion 16 can be fixed to the building support structure. Panels such as glass 18 are supported by the mullions so that the panels are on the exterior of the building. The challenge is when attaching window shades to this structure, the window shade cannot be easily attached, even if at all, to the mullions.

Due to the structure of this building style, internal mounting aesthetics pleasing windows shades, and especially powered windows shades such as shown in U.S. Pat. No. 10,294,717, can be challenging to install and use. This is due in part to the fact that the curtain wall system can move independently from the building structure. Further, wiring for powered window shades can be challenging due to the nature, structure, and constriction of the curtain wall assembly.

Further, current brackets and mounts for roller window shades and shade systems are typically bulky, visible, and may detract from the aesthetics of the shade system. Hence, there remains a need for improved assembly for mounting shades and shade systems, including motorized shades.

Therefore, it is an object of the present system to provide for a mounting bracket for curtain walls that also allow for wiring to be installed and even concealed for aesthetics purposes.

BRIEF SUMMARY OF THE INVENTION

The above objectives are accomplished by providing a window shade mounting system for use with a curtain wall structure comprising: a mounting plate secured to a building material wherein the building material carries a curtain wall assembly and the mounting plate is disposed in a cavity defined by a curtain wall assembly, the building material, a fire block or any combination thereof; a support plate removable carried by the mounting plate; a bracket attached to the mounting plate having a first end configured to bear against the mounting plate; a member included in the bracket wherein the member is configured to engage a roller window shade assembly and the member configured to limit rotation of at least a portion of the roller window shade assembly; a passage defined in the bracket for receiving a wire that travels from the cavity, through the passage and connects to a roller shade assembly motor included in the roller window shade assembly; and, a decorative plate attached to the support plate.

The cavity can be defined by the curtain wall assembly, the fire block, the mounting plate, the support plate, or any combination thereof. The support plate can be removable attached to the mounting plate. The wire can include a first connector positioned at an end of the wire, and wherein a motor included in the roller window shade assembly includes a second connector configured to selectively engage the first connector, thereby selectively electrically coupling the motor and the wire. The bracket can be configured such that when the bracket is coupled to the support plate, the combination of the bracket and the roller window shade assembly completely obscures a view of at least a portion of the bracket to an observer. The mounting plate can include a first position wherein the bracket is visible to an observer and a second position where the bracket is obscured from an observer. The roller window shade assembly can be supported within the cavity in the second position.

A second end can be included in the bracket and opposite the first end wherein the second end is visible to an observer. The second end can be rounded.

The system can include a hanger assembly including a mounting plate and a support plate secured to a building material wherein the building material carries a curtain wall assembly wherein the hanger assembly is disposed between the curtain wall assembly and the building material; a bracket attached to the hanger assembly having a first end configured to bear against the mounting plate; a roller window shade assembly attached to the bracket; and, wherein the combination of the bracket and the roller window shade assembly completely obscures at least a portion of the support plate to an observer.

The window shade mounting system of claim 16 wherein the roller window shade assembly is a first roller shade assembly carried by the bracket and a second roller shade assembly carried by an opposite side of the bracket.

A system can include a hanger assembly including a mounting plate and a support plate secured to a building material wherein the building material carries a curtain wall assembly wherein the hanger assembly is disposed between the curtain wall assembly and the budding material; a bracket attached to the hanger assembly having a first end configured to bear against the mounting plate; and, a roller shade assembly attached to the bracket. The window shade mounting system of claim 19 wherein the mounting plate includes a first position wherein the bracket is visible to an observer and a second position where the bracket is obscured from an observer.

BRIEF DESCRIPTION OF THE SEVERAL VIEWS OF THE DRAWINGS

The construction designed to carry out the invention will hereinafter be described, together with other features thereof. The invention will be more readily understood from a reading of the following specification and by reference to the accompanying drawings forming a part thereof, wherein an example of the invention is shown and wherein.

DETAILED DESCRIPTION OF THE INVENTION

Figure 1:
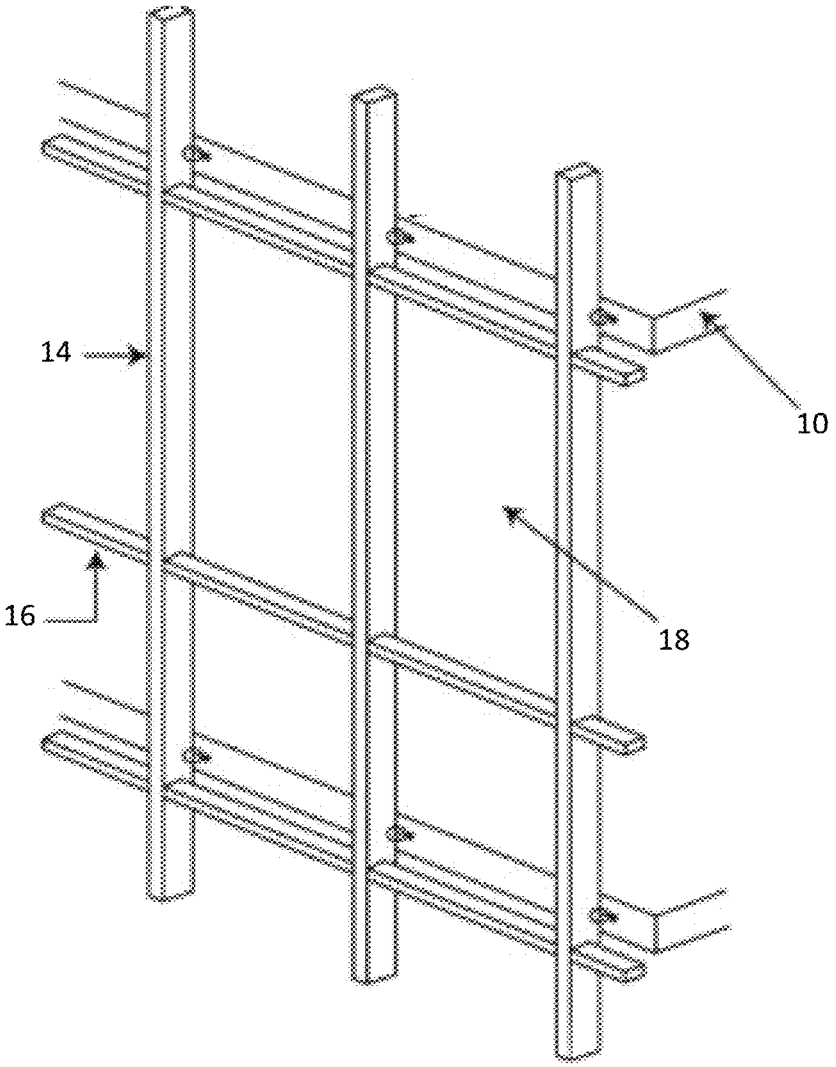
Prior Art Fig. 1
FIG. 1 is an example of a curtain wall structure that is in the prior art.

With reference to the drawings, the invention will now be described in more detail. FIG. 1 shows a curtain wall assembly.

Figure 2:
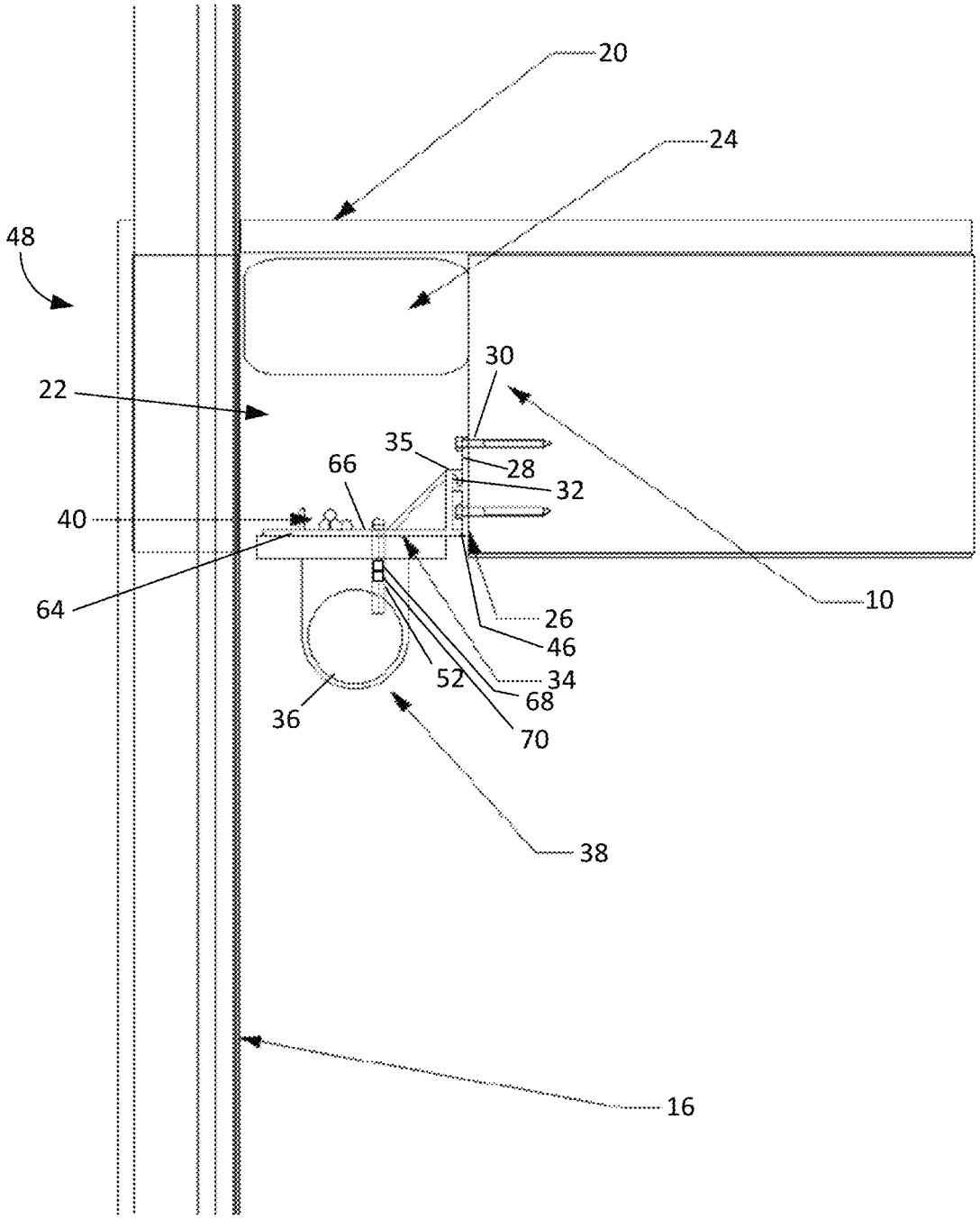
FIG. 2 is a side view of aspects of the system.

Referring to FIG. 2, the building structure 10 is shown supporting the flooring material 20 of the floor above the building material. A first cavity 22 can be defined by the building structure, upper flooring material, fire block, curtain wall structure 48 or any combination thereof. The curtain wall structure can include a mullion 16 which can be vertical or horizontal. The first cavity can have fire resistant material or a fire block 24 disposed in the first cavity or otherwise carried by the building structure. A hanger assembly 26 can be carried by the building material, affixed to the building material, or integrated into the building material. The hanger assembly can be disposed in the first cavity so that when a roller shade assembly is carried by the hanger assembly, the roller shade assembly is disposed under the building structure and visible from beneath the hanger assembly.

The hanger assembly can include a mounting plate 28 that can be carried by the building materials and, in one embodiment, can be affixed to the building material such as with fasteners 30. The hanger can be affixed to the building material during installation of the curtain wall or, in some cases, after installation of the curtain wall. The mounting plate can include a ledge 32 for supporting a support plate 34. A window shade 36 can be carried by the support plate. The support plate can include a groove 35 configured to engage with the ledge to support the support plate. A roller shade bracket 38 can be carried by the support plate and used to carry the roller shade assembly. Wiring 40 for a motorized window shade mounting assembly can be disposed in the first cavity and can be supported by the support plate, thereby being concealed by and supported by the support plate. In this configuration, the window shade can be disposed under the building material. The support plate can include an external wall 64 and internal wall 66. The wiring can be supported by the internal wall 64 while a decorative plate can be supported by the external wall 62. The decorative plate 42 or other structure can have a lower edge flush with the building material or other covering affixed to the building material.

A wire can include a first connector 68 positioned at an end of the wire, and wherein a motor included in the roller shade assembly can include a second connector 70 configured to selectively engage the first connector, thereby selectively electrically coupling the motor and the wire. These connectors allow the roller shade assembly to be removed from the mounting plate without having to remove the wiring that is disposed in the cavity.

Figure 3:
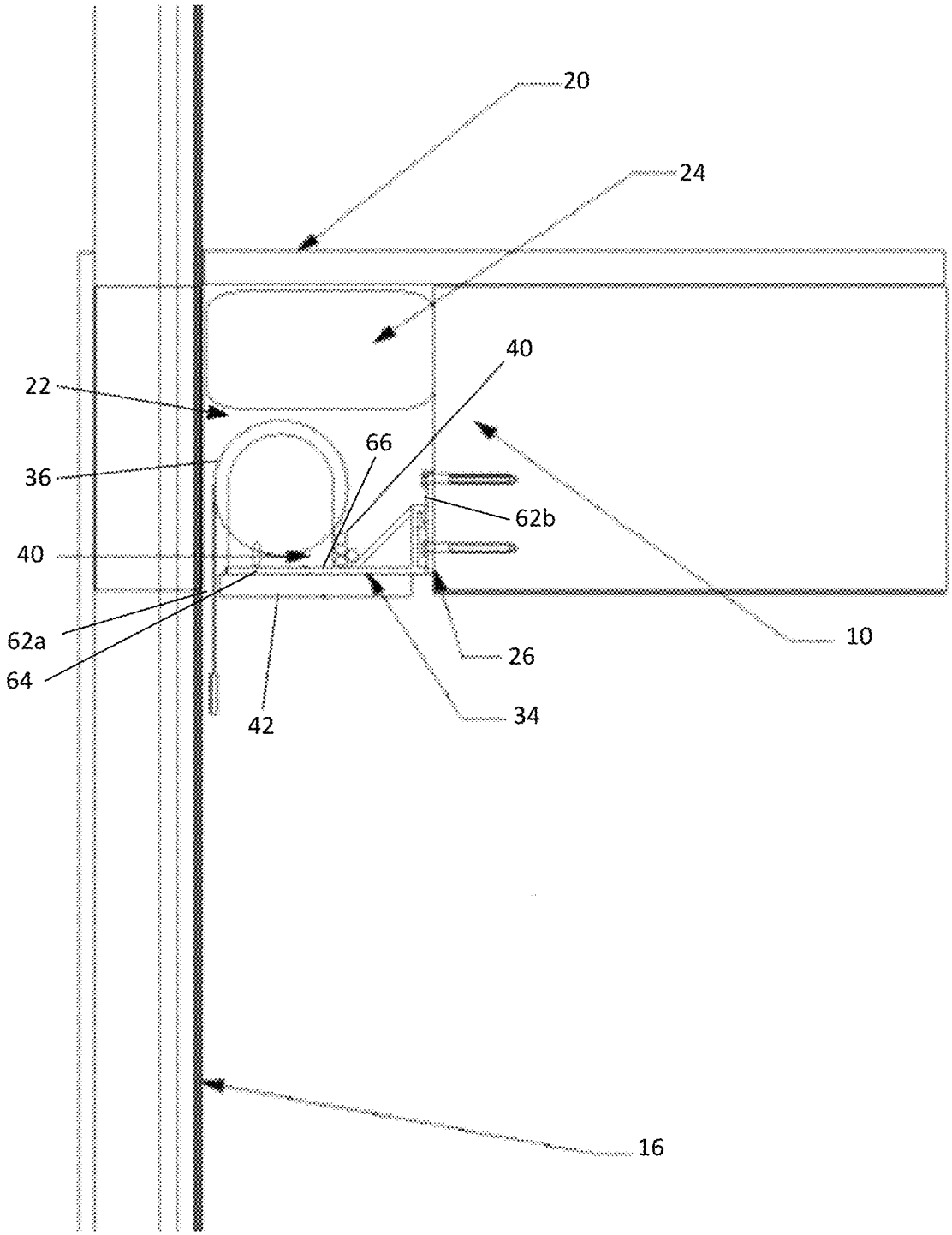
FIG. 3 is a side view of aspects of the system.

Referring to FIG. 3, the window shade 36 can be disposed in cavity 22 so that the window shade, when rolled in a retracted position, can be concealed by the support plate 34. The support plate can be custom sized for the specific curtain wall installment or can be manufactured in predetermined sizes for specific curtain walls. Wiring 40 can be disposed in the first cavity and can also be positioned or carried by the windows shade bracket. The support plate can carry a decorative plate 42. The use of a decorative plate can provide for an aesthetic look where the support plate and the decorative plate and building material have the same of similar look or accent each other. The motor for extending and retracting the windows shade can be disposed in the first cavity as well. In this embodiment, the internal wall is shown as 62*a* and the external wall is shown as 62*b*.

Figure 4:
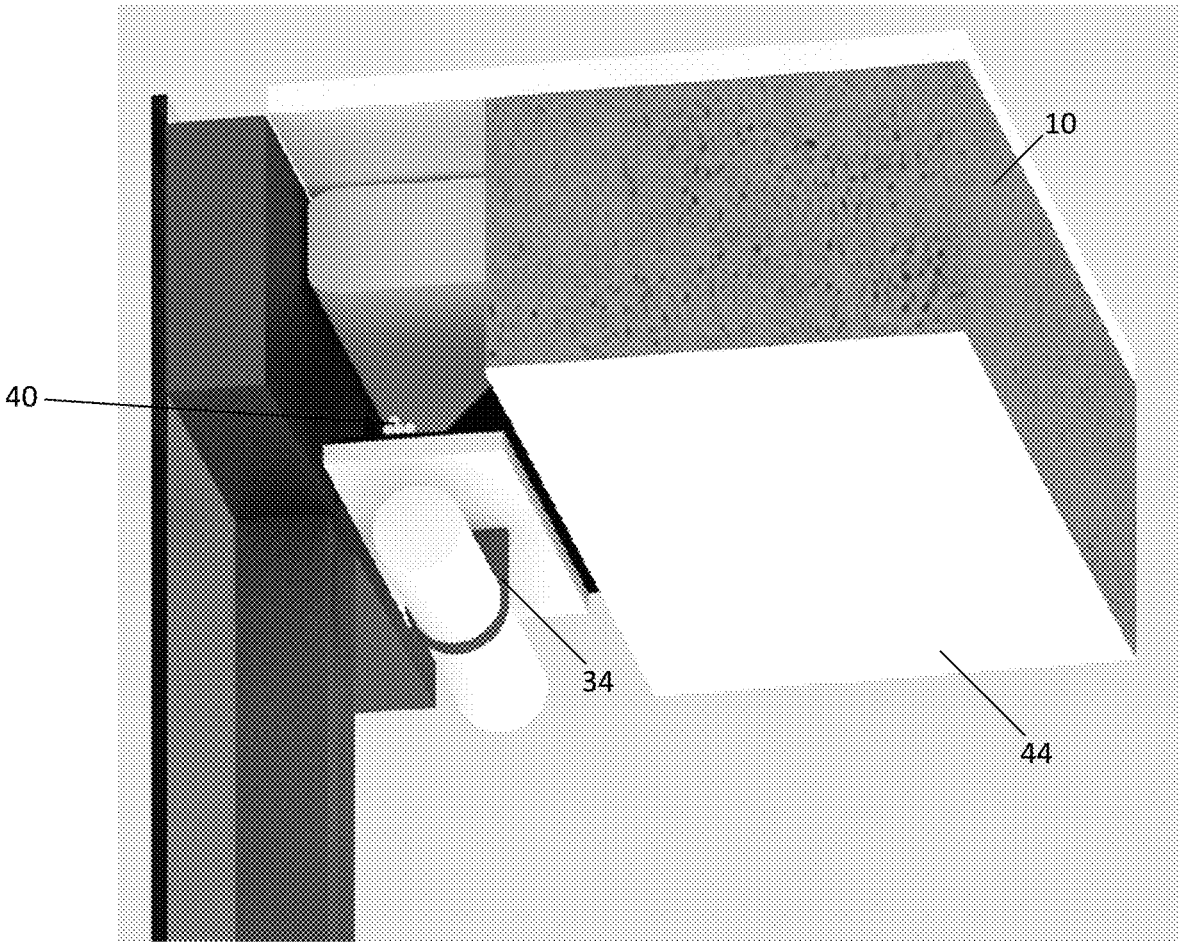
FIG. 4 is a perspective view of aspects of the system.

Referring to FIG. 4, the building material 10 can carry a ceiling material 44 such as paint, decorative panel or material, sound damping panel, or the like. The window shade mounting bracket 34 can support multiple window shades. Wiring 40 can be disposed in the first cavity 22 and can power one or more window shade motors.

Figure 5B:
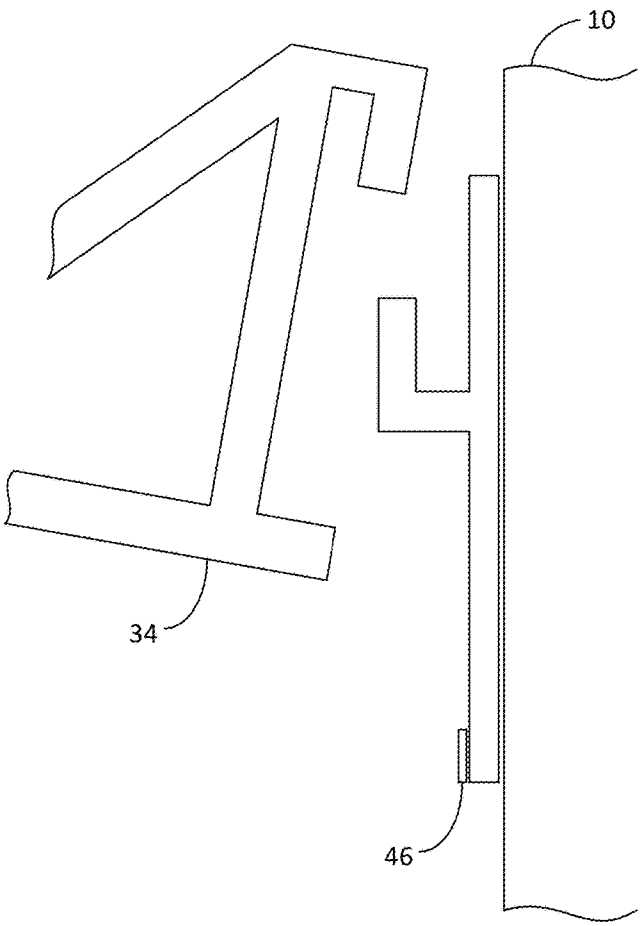
FIG. 5A through 5C are cross sections of aspects of the system.
Figure 5A:
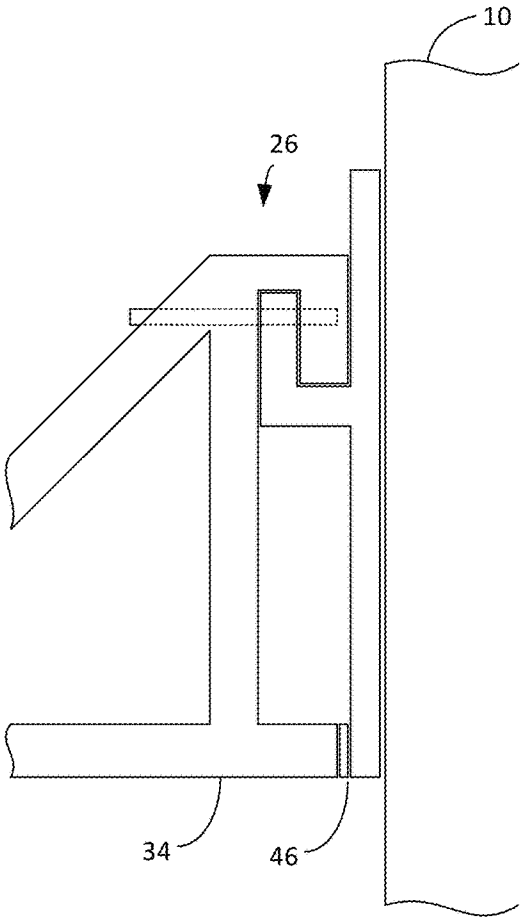
Figure 5C:
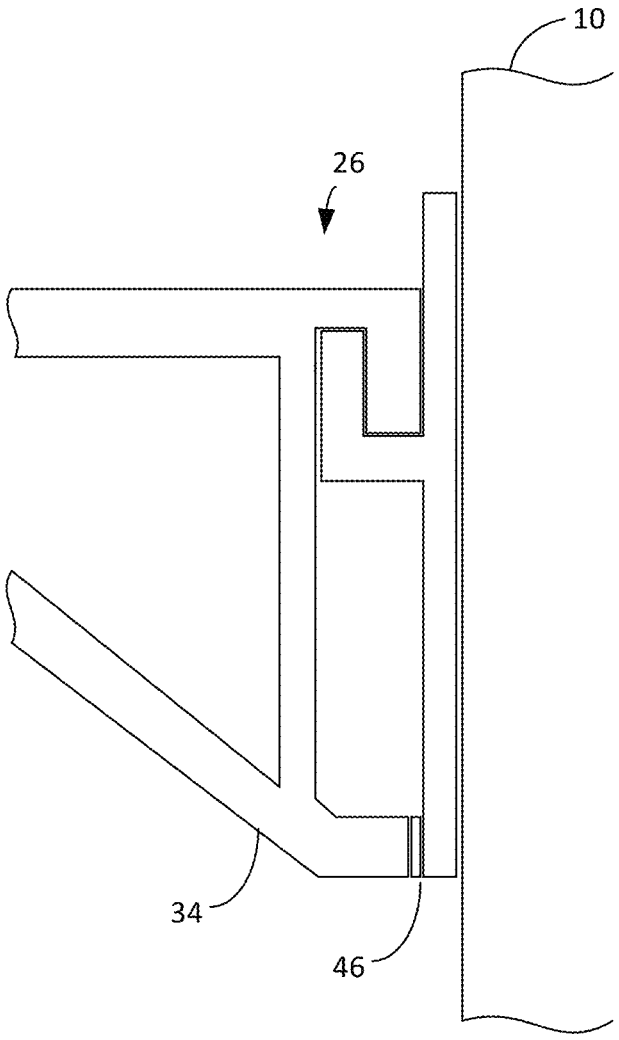
Figure 6:
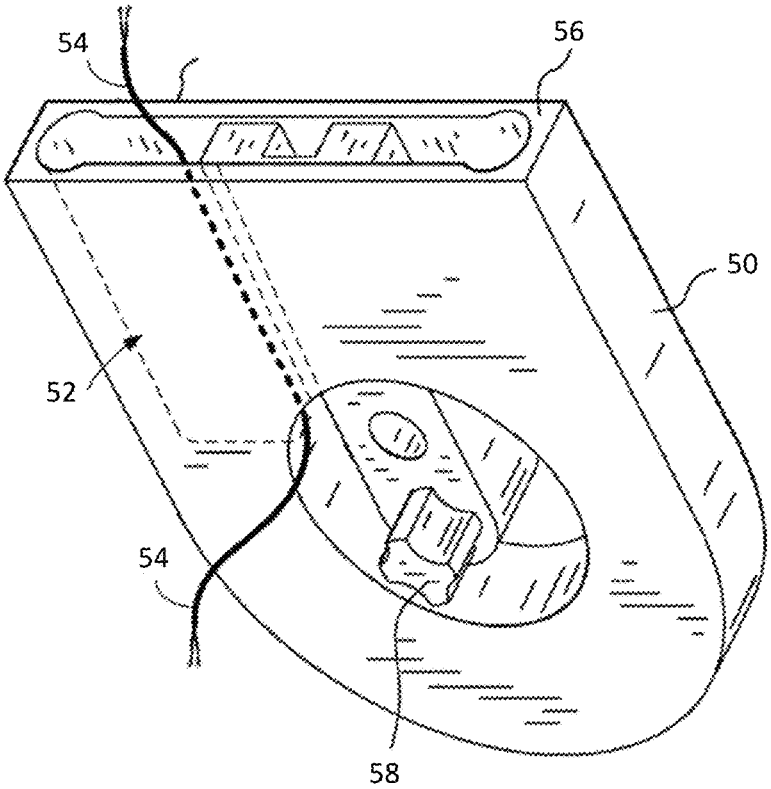
FIG. 6 is a perspective view of aspects of the system.

Referring to FIGS. 5A and 5B, the building material 10 can carry the mounting plate 28 of the hanger assembly 26. When connected, the supported plate 34 can be carried by the mounting plate and the roller shade assembly can be carried by the support plate. The mounting plate of the support plate can include a stop 46 allowing the support plate to rest on the mounting plate. When removed, the support plate can be lifted and rotated away from the mounting plate or can slide length wise e.g. horizontally along the support plate to be installed or positioned. A locking pin 48 can be received through the support plate and the mounting plate to prevent the mounting plate and the support plate from sliding or otherwise moving relative to each other when in an installed position. The embodiment shown in FIGS. 5A and 5B is a first support bracket position where the support bracket is configured to support a roller shade assembly so that at least a portion of the roller shade assembly is disposed beneath the building structure. The embodiment shown in FIG. 5C is a second support bracket position where the support bracket is configured to support a roller shade assemble so that at least a portion of the roller shade assembly is disposed above the building structure to obscure at least a portion of the roller shade assembly.

Referring to FIGS. 5A and 5B, the building material 10 can carry the mounting plate 28 of the hanger assembly 26. When connected, the supported plate 34 can be carried by the mounting plate and the roller shade assembly can be carried by the support plate. The mounting plate of the support plate can include a stop 46 allowing the support plate to rest on the mounting plate. When removed, the support plate can be lifted and rotated away from the mounting plate or can slide length wise e.g., horizontally along the support plate to be installed or positioned. A locking pin can be received through the support plate and the mounting plate to prevent the mounting plate and the support plate from sliding or otherwise moving relative to each other when in an installed position. The embodiment shown in FIG. 5A and 5B is a first support bracket position where the support bracket is configured to support a roller shade assembly so that at least a portion of the roller shade assembly is disposed beneath the building structure. The embodiment shown in FIG. 5C is a second support bracket position where the support bracket is configured to support a roller shade assemble so that at least a portion of the roller shade assembly is disposed above the building structure to obscure at least a portion of the roller shade assembly.

Figure 7:
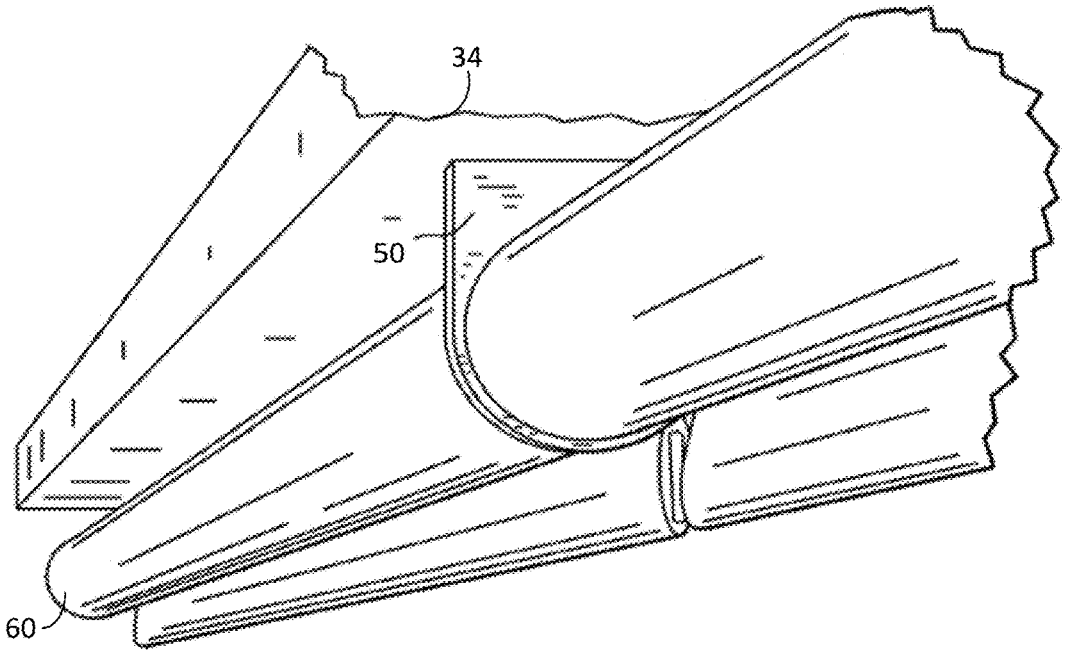
FIG. 7 is a perspective view of aspects of the system.

Referring to FIG. 7, a mounting bracket 50 can be affixed to the support panel 34 and can carry a roller shade assembly 60. The support panel can be disposed so that a portion is lower than the building structure or ceiling material so that at least a portion of the support plate is visible. The support panel can also be disposed so that a portion is above the building structure or ceiling material so that the roller shade bracket affixed to the support panel is not visible. In this embodiment, the roller shade can be extended or retracted through a shade opening 62 (FIG. 3). The hanger assembly allows for the roller shade assembly to be visible as in FIG. 2 or obscured as in FIG. 3 and by inverting the support plate, transition between these two embodiments, even after curtain wall has been installed.

The mounting bracket can support an end of a roller shade assembly in one embodiment and can support an end of two roller shade assemblies in one embodiment. The bracket can support a first roller shade assembly on one side and a second roller shade assembly on a second side.

It is understood that the above descriptions and illustrations are intended to be illustrative and not restrictive. It is to be understood that changes and variations may be made without departing from the spirit or scope of the following claims. Other embodiments as well as many applications besides the examples provided will be apparent to those of skill in the art upon reading the above description. The scope of the invention should, therefore, be determined not with reference to the above description, but should instead be determined with reference to the appended claims, along with the full scope of equivalents to which such claims are entitled. The disclosures of all articles and references, including patent applications and publications, are incorporated by reference for all purposes. The omission in the following claims of any aspect or subject matter that is disclosed herein is not a disclaimer of such subject matter, nor should it be regarded that the inventor did not consider such subject matter to be part of the disclosed inventive subject matter.

What is claimed is:

1. A window shade mounting system for use with a curtain wall structure comprising:

a mounting plate secured to a building material wherein the building material carries a curtain wall assembly and the mounting plate is disposed in a cavity defined by the curtain wall assembly, the building material, a fire block or any combination thereof;

a support plate removably carried by the mounting plate;

a bracket attached to the mounting plate having a first end configured to bear against the mounting plate;

a member included in the bracket wherein the member is configured to engage a roller window shade assembly and the member configured to limit rotation of at least a portion of the roller window shade assembly;

a passage defined in the bracket for receiving a wire that travels from the cavity, through the passage and connects to a roller shade assembly motor included in the roller window shade assembly; and, a decorative plate attached to the support plate.

2. The window shade mounting system of claim 1 wherein the cavity defined by the curtain wall assembly, the fire block, the mounting plate, the support plate or any combination thereof.

3. The window shade mounting system of claim 1 wherein the support plate is removably attached to the mounting plate.

4. The window shade mounting system of claim 1, wherein the wire includes a first connector positioned at an end of the wire, and wherein a motor included in the roller window shade assembly includes a second connector configured to selectively engage the first connector, thereby selectively electrically coupling the motor and the wire.

5. The window shade mounting system of claim 1 wherein the bracket is configured such that when the bracket is coupled to the support plate, the combination of the bracket and the roller window shade assembly completely obscures a view of at least a portion of the bracket to an observer.

6. The window shade mounting system of claim 1 wherein the mounting plate includes a first position wherein the bracket is visible to an observer and a second position where the bracket is obscured from an observer.

7. The window shade mounting system of claim 6 wherein the roller window shade assembly is supported within the cavity in the second position.

8. The window shade mounting system of claim 1 including a second end included in the bracket and opposite the first end wherein the second end is visible to an observer.

9. The window shade mounting system of claim 8 including a rounded portion included in the second end that is visible to an observer.

10. A window shade mounting system for use with a curtain wall structure comprising:

a mounting plate secured to a building material wherein the building material carries a curtain wall assembly and the mounting plate is disposed in a cavity defined by the curtain wall assembly, fire block, or any combination thereof;

a support plate removably carried by the mounting plate and disposed between the curtain wall assembly and the building material;

a bracket attached to the mounting plate having a first end configured to bear against the mounting plate; and, a roller window shade assembly attached to the bracket.

11. The window shade mounting system of claim 10 including a passage defined in the bracket for receiving a wire that travels from the cavity, through the passage and connects to a roller shade assembly motor included in the roller window shade assembly to supply power to the roller shade assembly motor.

12. The window shade mounting system of claim 10 including a decorative plate attached to the support plate.

13. The window shade mounting system of claim 10 wherein the bracket is configured such that when the bracket is coupled to the support plate, the combination of the bracket and the roller window shade assembly completely obscures a view of at least a portion of the bracket to an observer.

14. The window shade mounting system of claim 10 wherein the mounting plate includes a first position wherein the bracket is visible to an observer and a second position where the bracket is obscured from an observer.

15. The window shade mounting system of claim 10 wherein the roller window shade assembly is a first roller shade assembly carried by the bracket and a second roller shade assembly carried by an opposite side of the bracket.

16. A window shade mounting system for use with a curtain wall structure comprising:

a hanger assembly including a mounting plate and a support plate secured to a building material wherein the building material carries a curtain wall assembly wherein the hanger assembly is disposed between the curtain wall assembly and the building material;

a bracket attached to the hanger assembly having a first end configured to bear against the mounting plate;

a roller window shade assembly attached to the bracket; and, wherein the combination of the bracket and the roller window shade assembly completely obscures at least a portion of the support plate to an observer.

17. The window shade mounting system of claim 16 wherein the mounting plate includes a first position wherein the bracket is visible to an observer and a second position where the bracket is obscured from an observer.

18. The window shade mounting system of claim 16 wherein the roller window shade assembly is a first roller shade assembly carried by the bracket and a second roller shade assembly carried by an opposite side of the bracket.

19. A window shade mounting system for use with a curtain wall structure comprising:

a hanger assembly including a mounting plate and a support plate secured to a building material wherein the building material carries a curtain wall assembly wherein the hanger assembly is disposed between the curtain wall assembly and the building material;

a bracket attached to the hanger assembly having a first end configured to bear against the mounting plate; and, a roller shade assembly attached to the bracket.

20. The window shade mounting system of claim 19 wherein the mounting plate includes a first position wherein the bracket is visible to an observer and a second position where the bracket is obscured from an observer.

* * * * *